US006948651B2

(12) United States Patent
Ikeda

(10) Patent No.: US 6,948,651 B2
(45) Date of Patent: Sep. 27, 2005

(54) BLANK FOR A TUBULAR CARTON

(75) Inventor: Tamio Ikeda, Kawasaki (JP)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/745,751

(22) Filed: Dec. 24, 2003

(65) Prior Publication Data

US 2004/0245326 A1 Dec. 9, 2004

Related U.S. Application Data

(63) Continuation of application No. PCT/US02/21167, filed on Jul. 2, 2002.

(30) Foreign Application Priority Data

Jul. 2, 2001 (JP) ..... 2001-201321

(51) Int. Cl.[7] ..... B65D 5/42

(52) U.S. Cl. ..... 229/103.2; 206/427; 229/198.2; 229/935

(58) Field of Search ..... 229/103.2, 198.2, 229/933, 935, 936; 206/141, 427, 434

(56) References Cited

U.S. PATENT DOCUMENTS 2,795,365 A 6/1957 Currie
2,962,202 A * 11/1960 Hansen ..... 229/935
3,122,302 A 2/1964 Wood
3,202,339 A * 8/1965 Franklin, Jr. ..... 229/936
3,270,994 A 9/1966 Baker
4,491,223 A * 1/1985 Oliff ..... 206/434
4,498,618 A * 2/1985 Sutherland ..... 229/198.2
4,685,566 A * 8/1987 Wilson ..... 229/936
4,815,592 A * 3/1989 Kunkel ..... 206/815
4,989,778 A 2/1991 Saulas
5,000,313 A * 3/1991 Oliff ..... 206/427
5,004,104 A 4/1991 Saulas
5,263,633 A * 11/1993 Bicksler et al. ..... 229/933
5,605,228 A * 2/1997 Baxter ..... 206/427
5,853,088 A 12/1998 Saulas et al.

FOREIGN PATENT DOCUMENTS

WO 98/58853 A1 12/1998

* cited by examiner

*Primary Examiner*—Gary E. Elkins
(74) *Attorney, Agent, or Firm*—Tsugihiko Suzuki

(57) ABSTRACT

An elongate blank for forming a tubular carton includes panels arranged in a row along the length of the blank. The panels are hingedly connected one to another in series. Each panel has a pair of opposed free end edges disposed generally along the length of the blank. Each panel is formed along either free end edge thereof with a cutout so that the blank is provided along either longitudinal edge thereof with a plurality of tabs each interposed between adjacent cutouts. The cutouts are dimensioned and configured such that the tabs have an identical size and configuration and are complementary to at least some of the cutouts.

7 Claims, 5 Drawing Sheets

BLANK FOR A TUBULAR CARTON

This is a continuation of international application No. PCT/US02/21167, filed Jul. 2, 2002, which is hereby incorporated by reference.

BACKGROUND OF THE INVENTION

This invention relates generally to carton blanks for forming cartons for packaging a plurality of articles, and more particularly to a carton blank for forming a tubular carton.

A tubular carton may be formed from a carton blank of foldable sheet material such as paperboard. A typical tubular carton includes top and bottom opposed walls interconnected by a pair of opposed side walls to form a tubular structure having opposite open ends. Tubular cartons are economical because they require less paperboard to package articles. Because of the open ends, however, it is required that a tubular carton be provided with proper means for retaining articles within the carton.

An example of the article-retaining means is an aperture for receiving a top or bottom of a packaged article. A typical top-receiving aperture may be formed along the junction between the top wall and either side wall of the carton while a typical bottom-receiving aperture may be along the junction between the bottom wall and either side wall. To use the top or bottom-receiving apertures do not require additional paperboard and thus is one of the most economical approaches to retain articles within the tubular cartons. One drawback of these apertures, however, is that they detract from the structural strength of cartons, which would necessitates the use of higher caliper paperboard when the cartons are designed to be heavy-duty.

What is needed, therefore, is an economical carton blank that requires minimum amount of sheet material and yet provides a sturdy tubular carton having article-retaining means or an end retention structure for preventing the contents from dislodging through the open ends of the carton.

SUMMARY OF THE INVENTION

According to the present invention, there is provided an elongate carton blank for forming a tubular carton. The blank includes a plurality of panels arranged in a row along the length of the blank. The panels are hingedly connected one to another in series. Each panel has a pair of opposed free end edges disposed generally along the length of the blank. Each panel is formed along either free end edge thereof with a cutout so that the blank is provided along either longitudinal edge thereof with a plurality of tabs each interposed between adjacent cutouts. The cutouts are dimensioned and configured such that the tabs have an identical size and configuration and are complementary to at least some of the cutouts. The above arrangement allows the carton blanks to be horizontally arranged in a nested relationship and are thus helpful in increasing the number of carton blanks taken from paperboard of a standard width. When the blanks are nested, the cutouts along either longitudinal edge of each blank snugly receive the tabs of an adjacent one of the blanks.

According to a preferred embodiment of the invention, the cutouts may include end cutouts formed in the end panels located at the opposite ends of the blank and intermediate cutouts formed in the other panels. The intermediate cutouts may comprise the at least some cutouts and have an identical size and configuration.

According to another preferred embodiment of the invention, at least one of the tabs may comprise an end retention structure for preventing the contents of the carton from dislodging therefrom when the blank is erected into the carton. The one tab may be disposed astride a panel fold line along which two adjacent panels are hingedly connected.

In one variation of the above other preferred embodiment, the one tab may include an anchoring portion hingedly connected to one of the two adjacent panels to be folded into face contacting relationship with the one adjacent panel, a gusset portion hingedly connected to the anchoring portion, and a web portion hingedly connected to the gusset portion. The web portion may be connected to the other of the two adjacent panels to be in a folded position for engagement with a content of the carton. As an option, the one tab may further include a covering portion hingedly connected to the web portion while the covering portion may be integrally formed with the other adjacent panel. As another option, the panel fold line may be aligned with a web fold line along which the gusset portion and the web portion are connected.

In another variation, a content-receiving aperture may be formed in one of the two adjacent panels adjacent to the panel fold line. In this variation, the content-receiving aperture is disposed adjacent to the one tab so that the one tab can provide sufficient material in which the content-receiving aperture may be defined. The aperture may be formed at least in part in the one tab. Further, the content-receiving aperture may extend into the other of the two adjacent panels so as to interrupt the panel fold line

BRIEF DESCRIPTION OF THE DRAWINGS

Exemplary embodiments will now be described, by way of example only, with reference to the accompanying drawings, in which.

DETAILED DESCRIPTION OF THE PREFERRED EMBODIMENTS

Figure 1:
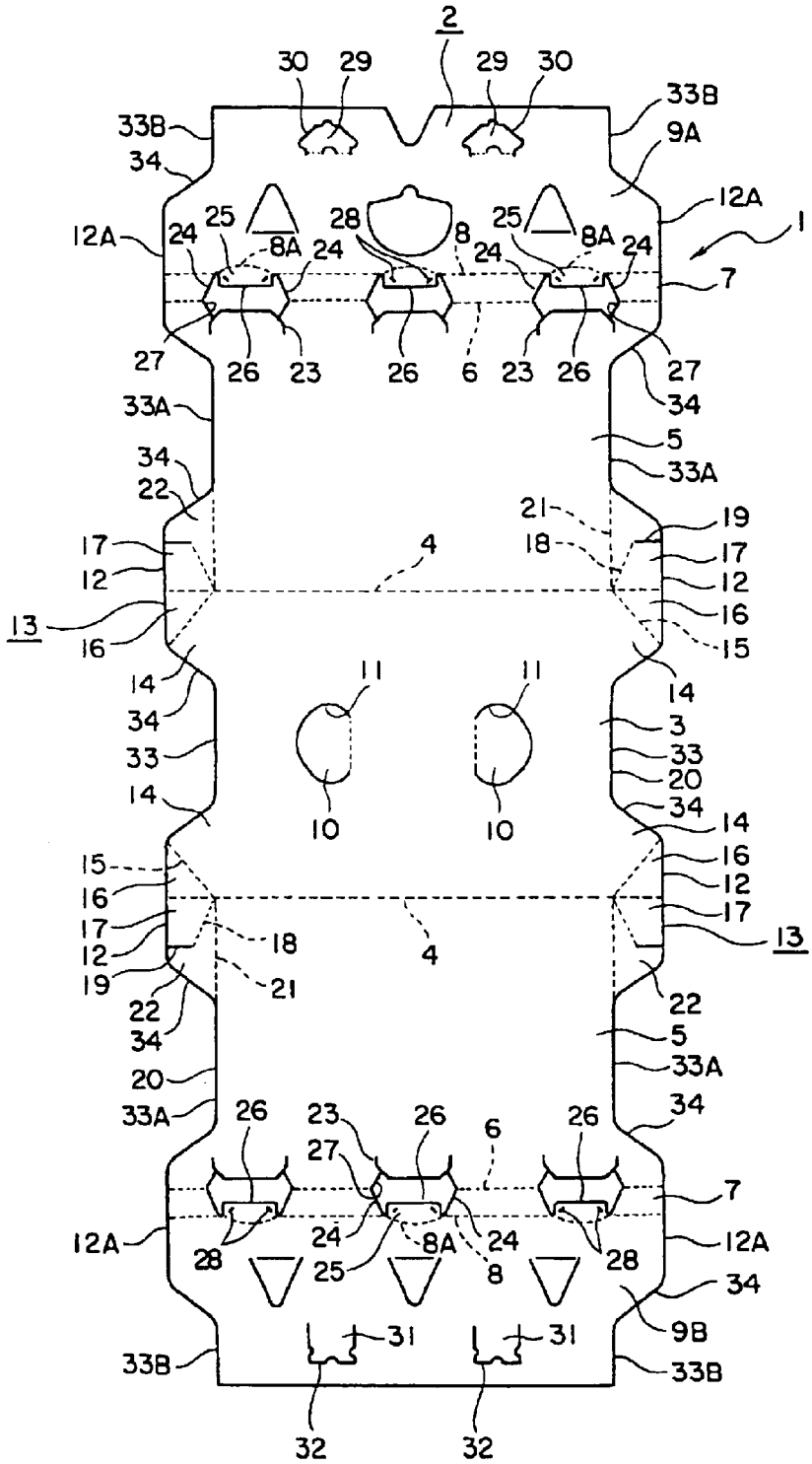
FIG. 1 is a plan view of a carton blank according to a first embodiment of the invention.
Figure 2:
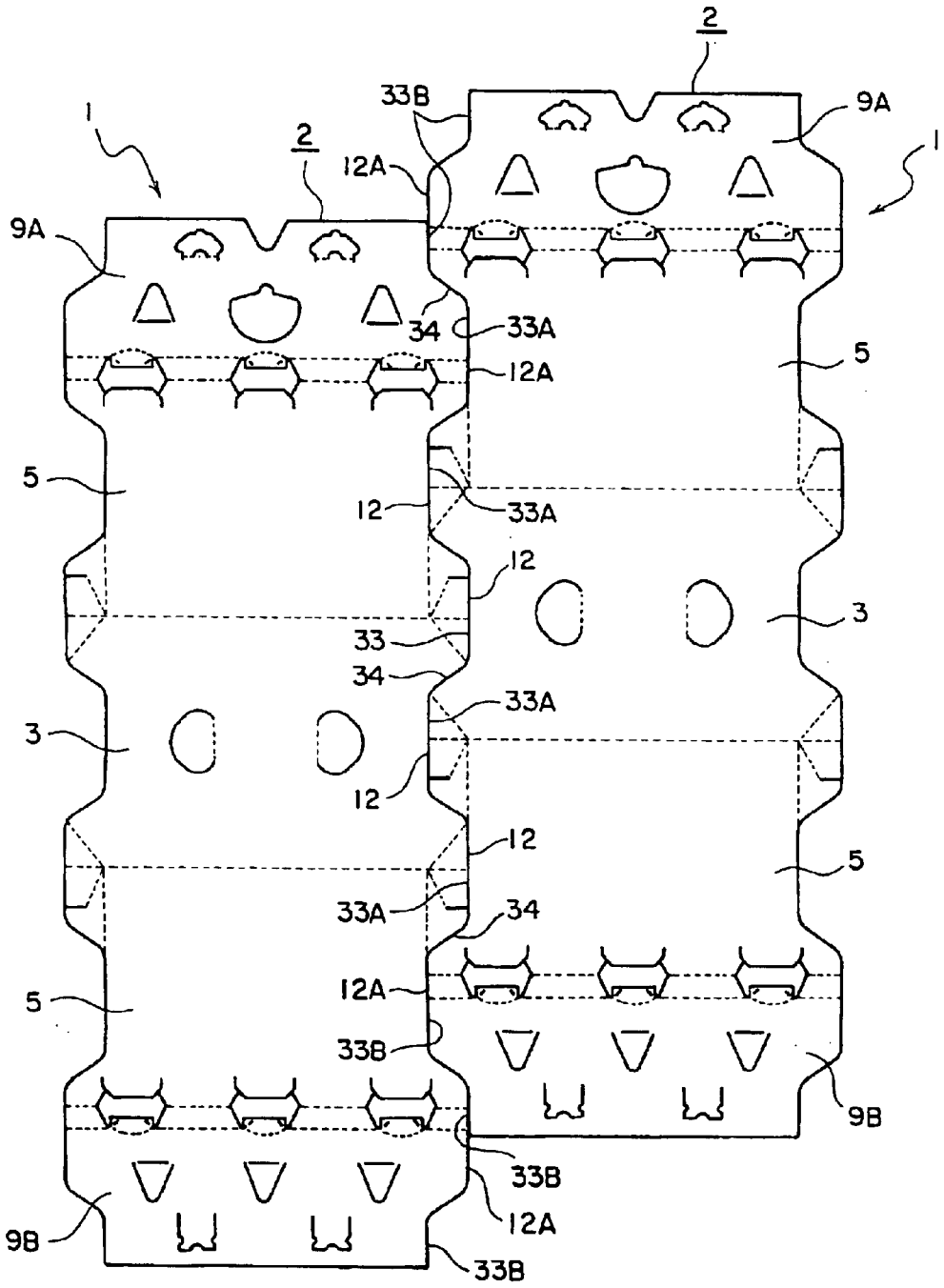
FIG. 2 is a plan view of a pair of like blanks arranged in a nested relationship, each of which is equivalent to the blank of FIG. 1.
Figure 3:
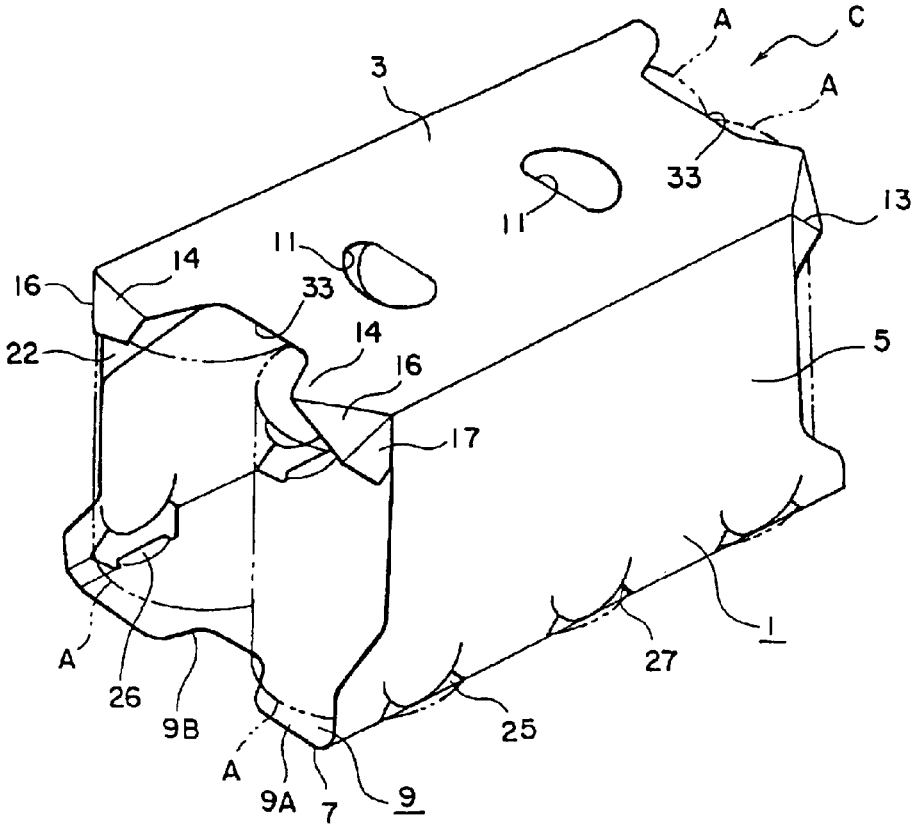
FIG. 3 is a perspective view of a carton erected from the blank of FIG. 1, showing the contents (i.e., cans) in the phantom lines.

FIGS. 1–4 illustrate the first embodiment of the present invention, in which FIG. 1 shows a blank 1 from which the tubular carton C of FIG. 3 is erected. The blank 1 is vertically elongated as viewed in FIG. 1 and is formed, in this embodiment, of paperboard. However, the blank may be formed of other foldable material such as a plastic sheet or the like. The blank 1 of this embodiment is designed for packaging six articles of an identical configuration, such as beer cans, arranged in two rows of three articles each. The blank 1 includes a rectangular top panel 3 located about midway along the length of the blank. A pair of side panels 5 and 5 are connected to the opposite side edges of the top panel 3 along fold lines 4 respectively.

Each side panel 5 is provided along its edge opposite to the top panel 3 with a beveled strip 7 that forms a sloping lower end portion of that side panel 5 when the blank is erected into a carton. The strips 7 and 7 are connected to the respective side panels 5 and 5 along fold lines 6 and 6 respectively. When the blank is erected into a carton, the beveled strips 7 and 7 are disposed at an angle with respect to the remainder of the side panels 5 and 5. The inclination angle of each beveled strip 7 is designed to correspond to the bottom shape of each article that is to be packaged in the carton. Bottom panel portions 9A and 9B are connected to the beveled strips 7 and 7 along fold lines 8 and 8 respectively. When the blank 1 is erected, the bottom panel portions 9A and 9B are secured together in an overlapping condition and form the bottom panel of the carton that vertically opposed to the top panel 3.

The above mentioned panels and panel portions 3, 5, 5, 9A and 9B are arranged in a row in the sequence of the panel portion 9A, one side panels 5, the top panel 3, the other side panel 5 and the panel portion 9B and hingedly connected one to the next as shown in FIG. 1.

The top panel 3 has a pair of foldable finger tabs 10 and 10 struck therefrom and hingedly connected thereto. These finger tabs 10 and 10, when folded inwardly, define in the top panel 3 a pair of finger apertures 11 and 11.

Figure 4:
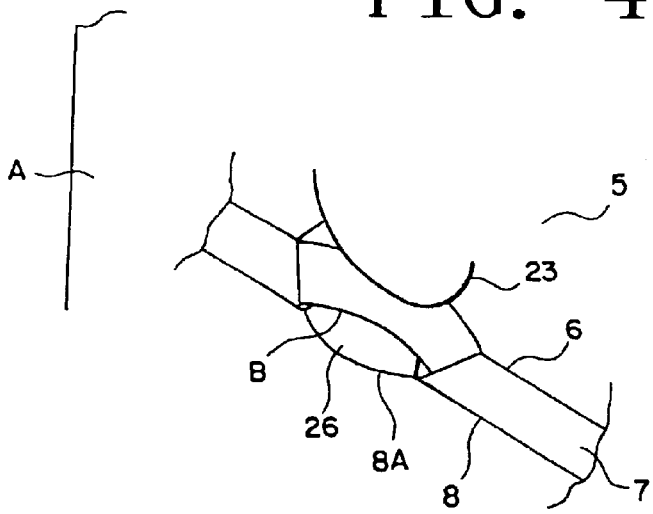
FIG. 4 is a fragmentary, side and bottom perspective view of the carton of FIG. 3; showing one of the bottom-receiving apertures.

Each side panel 5 is formed along its fold line 8 with article-receiving apertures 27 for receiving the bottom of the articles packaged in the carton formed from the blank 1. The apertures 27 of each side panel 5 are disposed astride the fold line 6 in such a manner that they interrupt the beveled strip 7. In this embodiment, each aperture 27 extends into the adjacent bottom panel portion 9A or 9B and thus the fold line 8 between that panel portion and the side panel 5 is also interrupted. Each aperture 27 is provided with a retention tab 26 that extends from the adjacent bottom panel portion 9A r 9B into the respective aperture 27. Each retention tab 26 is formed in part from the respective beveled strip 7 and in part from the adjacent bottom panel portion 9A or 9B and hingedly connected to the adjacent bottom panel portion along an arched fold line 8A. When the blank 1 is erected, the retention tabs 26 are folded inwardly of the carton along the fold lines 8A and engage the inside surfaces of the recesses at the bottoms of the packaged articles B as best shown in FIG. 4.

The bottom panel portions 9A and 9B are provided with a panel interlocking arrangement for securing the panel portions 9A and 9B together in an overlapping relationship. The arrangement includes a pair of male and female tabs 29 and 31 that are struck from, and hingedly connected to, the panel portions 9A and 9B, respectively. These tabs are well known in the art of the tubular carton as means for holding an elongate blank in a tubular form that is tightly wrapped around a group of articles.

Each of the panels and the panel portions 3, 5, 5, 9A and 9B is formed with a pair of cutouts. More particularly, a full cutout 33 is defined in the top panel 3 around the midway along each of its opposed end edges, and a full cutout 33A is defined in each of the side panels 5 and 5 around the midway along each of its opposed end edges. These full cutouts 33, 33, 33A and 33A have the same size and configuration. A half cut out 33B is defined in each of the bottom panel portions 9A and 9B at the outer end of each of its opposed end edges. As a result, the blank 1 is provided along either longitudinal edge thereof with four tabs 12, 12, 12A and 12A each interposed between adjacent ones of the cutouts. As illustrated in FIG. 1, each upper tab 12 is sandwiched and defined by the adjacent cutouts 33 and 33A while each lower tab 12A is sandwiched and defined by the adjacent cutouts 33A and 33B. Each upper tab 12 is positioned astride the adjacent fold line 4 while each lower tab 12A is positioned astride the adjacent fold line 8. Further, the full and half cutouts 33, 33, 33A, 33A, 33B and 33B are dimensioned and configured such that the upper and lower tab 12, 12, 12A and 12A have an identical size and configuration and that each tab is complementary to each full cutout 33 and 33A.

Each of the upper and lower tabs 12 and 12A forms, or assists in forming of, an end retention structure for preventing the contents of the carton from dislodging from the carton when said blank is erected into the carton. Each upper tab 12 is provided with cut and fold lines to form a top-engaging structure when it is folded along the fold lines. More specifically, each upper tab 12 comprises an anchoring portion 22 hingedly connected to the adjacent side panel 5 along a fold line 21, a gusset portion 17 hingedly connected to the anchoring portion 22 along a fold line 18, a web portion 16 hingedly connected to the gusset portion 17 along an extension of the fold line 4, and a covering portion 14 that is integrally formed with the top panel 3. A cut line 19 extends from the fold line 18 to the outer edge of the respective upper tab 12. The extension of the fold line 4, in this particular embodiment is aligned with the main length of the fold line 4; however, the extension may be disposed at an angular relationship with the main length depending on the shape of the content or article with which the top-engaging structure is to engage. The angle of the extension relative to main length of the fold line 4 can be a factor that decide the angle of the web portion 16 with respect to the top panel 3 upon formation of the carton.

Folding of each upper tab 12 is achieved during the erection of the carton. To form a top-engaging structure out of each upper tab 12, the anchoring portion 22 is folded about 180 degrees to bring it into a face-contacting relationship with the inside surface of the adjacent side panel 5. The anchoring portion 22 is held in the folded position as being pressed by one of the packaged articles A against the adjacent side panel 5. The folding of the anchoring portion 22 causes the gusset portion 17 to be folded outwardly about the fold line 18 so that the gusset portion 17 extends outwardly from the fold line 18 along the side wall of the one packaged article A. At the same time, the web portion 16 is caused to fold downwardly along the fold line 15 and is thereby brought to a folded position where it extends between the fold line 15 and the outer edge of the gusset portion. The top-engaging structure thus completed is illustrated in FIG. 3 wherein the structure is shown as tightly engaging the top of the one article A.

Each lower tab 12A serves to provide sufficient material in which the adjacent end aperture 27 is defined. More particularly, the article-receiving aperture 27 adjacent to each lower tab 12A is positioned such that sufficient material surround the aperture 27 even when the aperture 27 extends into that lower tab 12A. During the erection and packaging of articles, the blank 1 is manipulated so that the apertures 27 each receives the bottom of the respective article to retaining the articles within the carton. The retention tabs 26 are also folded to assist in retaining the articles as described earlier.

FIG. 2 shows how the blank 1 of the above arrangement allows like carton blanks to be horizontally arranged in a nested relationship. Referring to FIG. 2, the full cutout 33 along the left hand side longitudinal edge of the right hand side blank 1 can snugly receive one of the tabs 12 along the right hand side longitudinal edge of the left hand-side blank 1. Each of the full cutout 33A along the left hand side longitudinal edge of the right hand-side blank 1 can snugly receive either the tab 12 or 12A along the right hand side longitudinal edge of the left hand side blank 1. Further, each of the half cutout 33B along the left hand side longitudinal edge of the right hand-side blank 1 can snugly receive part of one of the tabs 12A along the right hand side longitudinal edge of the left hand side blank 1 or of another like blank which can be arranged near the upper-left corner of the right hand side blank. As apparent from FIG. 2, a number of like blanks can be horizontally arranged in a similar manner as described above so that they are efficiently taken from paperboard without producing any scraps.

Figure 5:
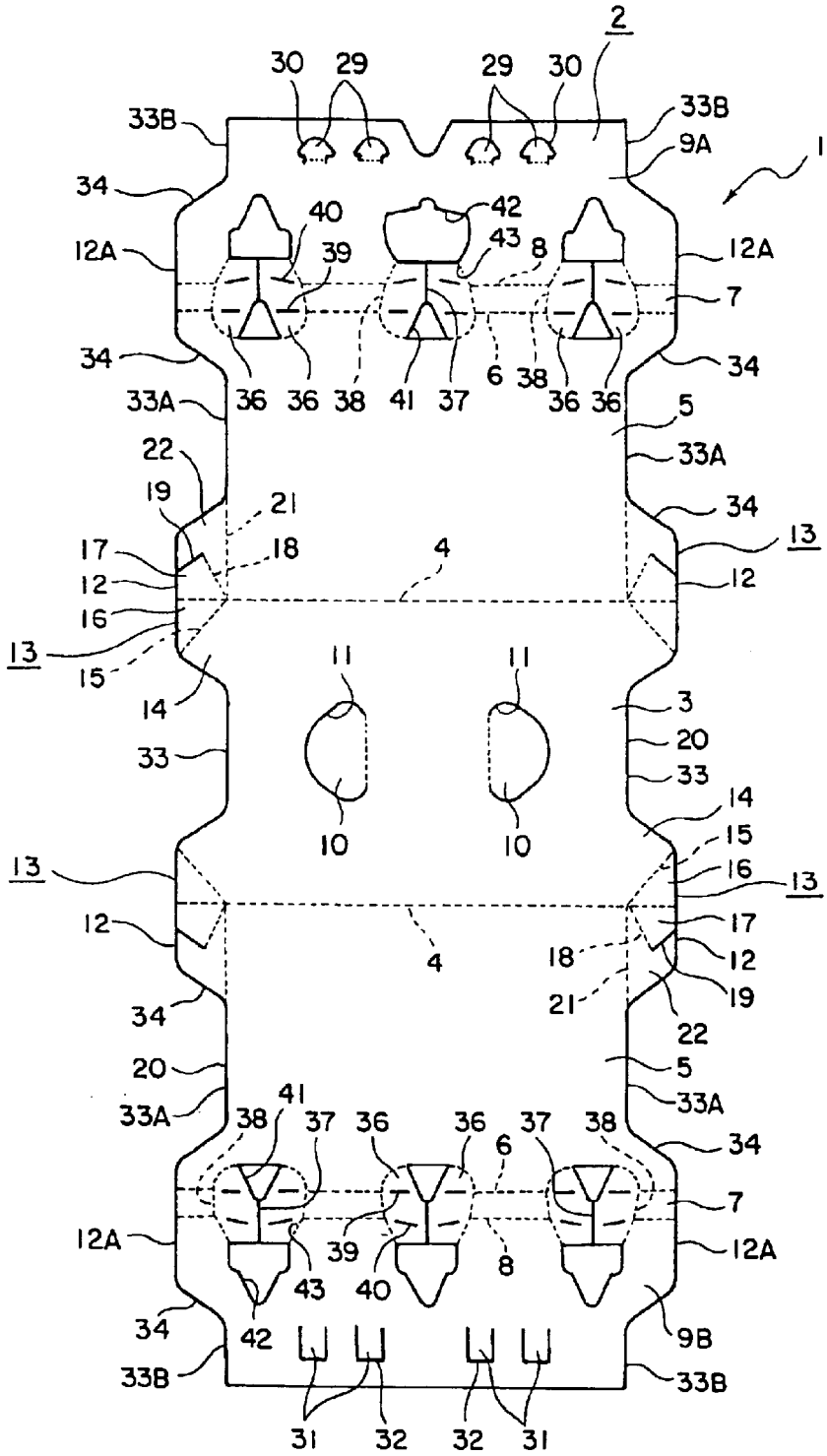
FIG. 5 is a plan view of a carton blank according to a second embodiment of the invention.
Figure 6:
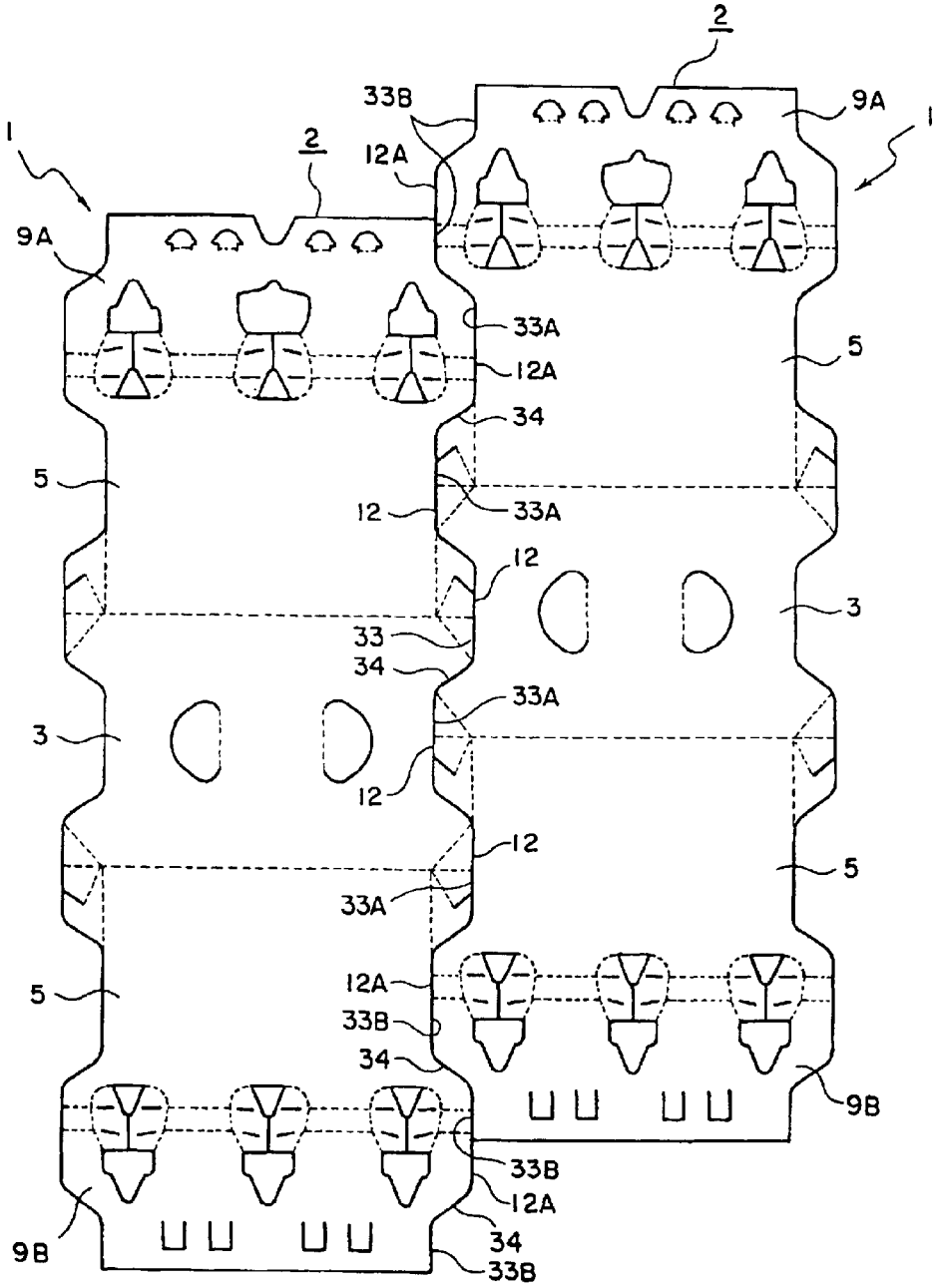
FIG. 6 is a plan view of a pair of like blanks arranged in a nested relationship, each of which is equivalent to the blank of FIG. 5.

FIGS. 5 and 6 illustrate the second embodiment of the present invention. Like reference numerals have been used for like parts of the first embodiment and therefore only the differences from the first embodiment are described in any greater detail. The blank of FIG. 5 differs from that of FIG. 1 in that the bottom retention apertures 42 extend considerably into the respective bottom panel portions 9A or 9B and that each aperture 42 is provided with a pair of foldable retention flaps 36 and 36. These flaps 36 and 36 are folded inwardly of the carton upon the erection of the carton to be placed between the bottom of the respective article and the bottom panel of the carton. The flaps 36 are useful not only to protect the associated article from physical impact but also to reinforce the peripheral area of the respective aperture 42. The panel interlocking arrangement 29 and 31 employed in the blank of this embodiment is also different from that in the first embodiment. The interlocking arrangement in this embodiment is also well known in the art of the tubular carton. The other parts of the blank of this embodiment are virtually identical to those of the first embodiment.

While the present invention has been described with preferred embodiments, it should be understood that variations and modifications may be resorted to as will be apparent to those skilled in the art. Such variations and modifications are to be considered within the purview and the scope of the claims appended hereto.

It should be readily apparent that each lower tab 12A may be replaced by a tab structurally equivalent to each upper tab 12. In such an arrangement, the article receiving apertures may be omitted. It should be also apparent that the locations of the upper and lower tabs 12 and 12A may be exchanged. In such an arrangement, the beveled strip 7 of each side panel and the article-receiving apertures thereof should be relocated to the area along the upper edge of that side panel.

It should be also readily apparent that each upper tab 12 may be replaced by a tab structurally equivalent to each lower tab 12A. In such an arrangement, the article receiving apertures should be additionally formed in the upper edge area of each side panel.

It will be recognized that as used herein, directional references such as "top", "bottom", "end", "side", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

What is claimed is:

1. An elongate blank for forming a tubular carton, said blank comprising a plurality of panels arranged in a row along a length of the blank, said panels being hingedly connected one to another in series, each of said panels having a pair of opposed free end edges disposed generally along the length of the blank, said each panel being formed along either free end edge thereof with a cutout so that said blank is provided along either longitudinal edge thereof with a plurality of tabs each interposed between adjacent ones of said cutouts, said cutouts being dimensioned and configured such that said tabs have an identical size and configuration and are complementary to at least some of said cutouts, at least one of said tabs comprising an end retention structure for preventing contents of the carton from dislodging from the carton when said blank is erected into the carton, wherein said at least one tab is disposed astride a panel fold line along which two adjacent ones of said panels are hingedly connected, wherein said at least one tab comprises an anchoring portion hingedly connected to one of said two adjacent panels to be folded into face contacting relationship with said one adjacent panel, a gusset portion hingedly connected to said anchoring portion, and a web portion hingedly connected to said gusset portion, said web portion being connected to the other of said two adjacent panels to be in a folded position for engagement with a content of the carton.

2. The carton according to claim 1 wherein said cutouts include end cutouts formed in two end ones of said panels located at the opposite ends of said blank respectively and intermediate cutouts formed in the others of said panels, said intermediate cutouts comprising said at least some cutouts and having an identical size and configuration.

3. The carton according to claim 1 wherein said at least one tab further comprises a covering portion hingedly connected to said web portion, said covering portion being integrally formed with said other adjacent panel.

4. The carton according to claim 1 wherein said gusset portion and said web portion are connected along a web fold line, and said panel fold line is aligned with said web fold line.

5. The carton according to claim 1 wherein each of at least some of said tabs other than said at least one tab is disposed astride a further panel fold line along which two neighboring ones of said panels are hingedly connected, wherein a content-receiving aperture is formed in one of said two neighboring panels adjacent to said further panel fold line, and said content-receiving aperture is disposed adjacent to said each of said at least some tabs.

6. The carton according to claim 5 wherein said content-receiving aperture is formed at least in part in said each of said at least some tabs.

7. The carton according to claim 5 wherein the content-receiving aperture extends into the other of the two neighboring panels so as to interrupt said further panel fold line.

* * * * *